US006128884A

United States Patent [19]

Berdan, II et al.

[11] Patent Number: 6,128,884

[45] Date of Patent: Oct. 10, 2000

[54] UNIVERSAL INSULATION PRODUCT AND METHOD FOR INSTALLING

[75] Inventors: Clarke Berdan, II; Frank C. O'Brien-Bernini, both of Granville; William A. Watton, Pickerington, all of Ohio

[73] Assignee: Owens Corning Fiberglas Technology, Inc., Summit, Ill.

[21] Appl. No.: 09/088,974

[22] Filed: Jun. 2, 1998

[51] Int. Cl.[7] ..... E04B 1/78

[52] U.S. Cl. ..... 52/742.12; 52/406.2; 52/407.3

[58] Field of Search ..... 52/742.12, 742.1, 52/406.1, 406.2, 406.3, 407.3, 407.4

[56] References Cited

U.S. PATENT DOCUMENTS

| | | | |
|---|---|---|---|
| 2,566,619 | 9/1951 | Lyon et al. . | |
| 3,141,206 | 7/1964 | Stephens | 52/406.2 |
| 3,180,778 | 4/1965 | Rinderspacher et al. . | |
| 3,546,846 | 12/1970 | Sens . | |
| 3,616,185 | 10/1971 | Goldberg . | |
| 3,955,031 | 5/1976 | Jones et al. . | |
| 4,370,374 | 1/1983 | Raabe et al. . | |
| 4,381,330 | 4/1983 | Gotomyo et al. . | |
| 4,420,521 | 12/1983 | Carr . | |
| 4,759,964 | 7/1988 | Fischer et al. . | |
| 4,927,705 | 5/1990 | Syme et al. . | |
| 4,968,556 | 11/1990 | Jain . | |
| 4,975,316 | 12/1990 | Romanowski . | |
| 5,169,700 | 12/1992 | Meier et al. . | |
| 5,211,988 | 5/1993 | Morton . | |
| 5,240,527 | 8/1993 | Lostak et al. . | |
| 5,277,955 | 1/1994 | Schelhorn et al. . | |
| 5,318,644 | 6/1994 | McBride t al. . | |
| 5,362,539 | 11/1994 | Hall et al. . | |
| 5,435,963 | 7/1995 | Rackovan et al. . | |
| 5,466,504 | 11/1995 | Gavin et al. . | |
| 5,508,079 | 4/1996 | Grant et al. | 52/406.1 |
| 5,609,934 | 3/1997 | Fay . | |
| 5,633,064 | 5/1997 | Ragland et al. . | |
| 5,674,600 | 10/1997 | Hargarter et al. . | |
| 5,733,624 | 3/1998 | Syme et al. . | |
| 5,746,854 | 5/1998 | Romes et al. . | |

FOREIGN PATENT DOCUMENTS

| | | |
|---|---|---|
| 839968A1 | 5/1998 | European Pat. Off. . |

*Primary Examiner*—Michael Safavi
*Attorney, Agent, or Firm*—Inger H. Eckert; Stephen W. Barns

[57] ABSTRACT

An insulation product includes an elongated comformable body of fibrous insulation having front and rear major surfaces and two elongated side surfaces. A facing is adhered to the front major surface of the conformable body, the facing having sufficient tensile strength to withstand a pressure, without tearing, of about 1.0 pound per square foot from the fibrous insulation in a wall cavity defined by wall studs, when the facing is adhered to the wall studs. The facing is bonded to the conformable body with sufficient strength to provide product integrity to the insulation product when it is cut lengthwise. The insulation product can be expanded when unconstrained to a high loft thickness so that when the batt is placed in an insulation cavity having a thickness less than or equal to the high loft thickness, the insulation product can be expanded to fill the insulation cavity. The fibrous insulation material has a resistance to compression less than about 1.0 pound per square foot when compressed to a thickness of about 40 percent the unconstrained high loft thickness.

8 Claims, 7 Drawing Sheets

UNIVERSAL INSULATION PRODUCT AND METHOD FOR INSTALLING

TECHNICAL FIELD AND INDUSTRIAL APPLICABILITY OF THE INVENTION

This invention relates to fibrous insulation products, and in particular those insulation products of the type suitable for fitting into insulation cavities in buildings.

BACKGROUND OF THE INVENTION

Fibrous insulation is typically formed by fiberizing molten material and depositing the fibers on a collecting conveyor. Typically the fibers for insulation products are mineral fibers, such as glass fibers, although some insulation products are made of organic fibers, such as polypropylene. Most fibrous insulation products contain a binder material to bond the fibers together where they contact each other, forming a lattice or network. The binder gives the insulation product resiliency for recovery after packaging, and provides stiffness and handleability so that the product can be handled and applied as needed in the insulation cavities of buildings. During manufacturing the insulation is cut into lengths to form individual insulation products, and the insulation products are packaged for shipping to customer locations.

One typical insulation product is an insulation batt, usually about 8 feet long, and generally suitable for use as wall insulation in residential dwellings, or as insulation in the attic and floor insulation cavities in buildings. The width of insulation batts designed for wall cavities is set to typical insulation cavity widths, such as about 14½ inches or 22½ inches for stud spacings of 16 and 24 inches, respectively. Some insulation products have a facing on one of the major surfaces. In many cases the facing acts as a vapor barrier, and in some insulation products, such as binderless products, the facing gives the product integrity for handleability. Faced insulation products are installed with the facing placed flat on the edge of the insulation cavity, typically the interior side or edge of the insulation cavity.

Insulation products where the facing is a vapor barrier are commonly used to insulate wall, floor or ceiling cavities that separate a warm interior space from a cold exterior space. The vapor barrier is usually placed to prevent moisture-laden air from the warm interior of the dwelling from entering the insulation. Otherwise, the water vapor in the warm interior air would enter the insulation material and then cool and condense within the insulation. This would result in a damp insulation product, which is incapable of performing at its designed efficiency. In warm climates it is sometimes preferable to install the vapor barrier on the exterior side of the insulation cavity to reduce the amount of vapor entering the building during the air conditioning season.

There are some insulation product requirements that call for insulation that is not vapor impermeable, but rather allows water vapor to pass through. For example, retrofit insulation products designed for adding additional insulation material on top of existing attic insulation should not have a vapor barrier. Also, insulation for wall cavities having a separate full wall vapor barrier, such as a 4.0 mil polyethylene film on the interior or warm side of the wall, do not require a vapor barrier on the insulation product itself. Further, encapsulation of fibrous glass batts for handling purposes is known. U.S. Pat. No. 5,277,995 to Schelhorn et al. discloses an encapsulated batt with an encapsulation material adhered with an adhesive that can be applied in longitudinal stripes, or in patterns such as dots, or in an adhesive matrix. The Schelhorn et al. patent also discloses that an alternative method of attachment is for the adhesive layer to be an integral part of the encapsulation film, which, when softened, bonds to the fibers in the batt. U.S. Pat. No. 5,733,624 to Syme et al. discloses a mineral fiber batt impregnated with a coextruded polymer layering system, and U.S. Pat. No. 5,746,854 to Romes et al. discloses a method for impregnating a mineral fiber batt with a coextruded film.

Vapor barriers for insulation products are typically created with a layer of asphalt in conjunction with a kraft paper or foil facing material. The asphalt layer is applied in molten form and it is pressed against the fibrous insulation material before hardening to bond the kraft facing material to the insulation material. This asphalt and kraft paper system has the advantage of being relatively inexpensive. However, this facing system lacks flexibility because the asphalt/kraft layer is stiff. Also, cutting the facing without tearing the kraft paper is difficult in cool ambient temperatures because the asphalt can be brittle. Further the asphalt material is sticky in hot ambient temperatures, resulting in a gumming up of the cutting tool.

Even though the batts are manufactured to fit typical insulation cavities, many of the insulation cavities in buildings are of nonstandard dimensions. Window frames, door jambs, vent pipes, air ducts and electrical conduit are some of the typical obstructions that change the shape of the insulation cavity. During the process of installing the batts a significant portion of the batts must be cut to fit these non is standard insulation cavities. In some dwellings up to 50 percent of the insulation cavities are nonstandard. Therefore, an important attribute of a faced building insulation product is the ease with which the facing can be cut and the ability of the facing to be placed flat on the edge of the insulation cavity after the facing has been cut. If the facing is not flat on the edge of the insulation cavity, the vapor barrier will be only partially effective. Further, insulation customers desire a smooth facing that is relatively flat on the edge of the insulation cavity.

In view of the above problems with currently available insulation products, it would be advantageous if there could be developed a faced insulation product having a facing material that can be easily cut to fit into nonstandard insulation cavities, and having a facing material that is flexible enough that it can accommodate installation of the cut insulation product into nonstandard insulation cavities with the facing in a flat condition at the edge of the insulation cavity.

In addition to the challenges of providing insulation products with suitable facings, insulation manufacturers are also faced with challenges in making insulation products easy to market by retailers and other building materials distributors. Insulation materials require a large amount of retail space, and it would be helpful if the retail showroom floor space could be reduced. A contributing factor in the requirement for large retail space is the need to sell products designed for numerous product applications. For example, most construction materials dealers offer their customers separate insulation products for such applications as R-13 walls (2×4 construction with a nominal designed thickness of 3½ inches) and R-19 attic insulation (unconstrained application with a high loft thickness that is typically greater than 6 inches.) Other insulation products are also offered. In addition to the retail space problem inherent in a large number of products, the multiplicity of products is sometimes confusing to customers.

Attempts in the past to provide a product that meets the requirements for all three of these applications have not been successful because the amount of compressive force generated in reaction to compressing the high loft, unconstrained product into a 3½ wall cavity tends to pop the screws in the drywall on the interior side, or to force the foam sheathing on the exterior side away from the studs. It would be advantageous if a single product could be designed that could be used for all three of these applications.

SUMMARY OF THE INVENTION

The above objects as well as other objects not specifically enumerated are achieved by an insulation product that includes an elongated conformable body of fibrous insulation having front and rear major surfaces and two elongated side surfaces. A facing is adhered to the front major surface of the conformable body, the facing having sufficient tensile strength to withstand a pressure, without tearing, of about 1.0 pound per square foot from the fibrous insulation in a wall cavity defined by wall studs, when the facing is adhered to the wall studs. The facing is bonded to the conformable body with sufficient strength to provide product integrity to the insulation product when it is cut lengthwise. The insulation product can be expanded when unconstrained to a high loft thickness, and so that when the batt is placed in an insulation cavity having a thickness less than or equal to the high loft thickness of the insulation product will expand to fill the insulation cavity. The fibrous insulation material has a resistance to compression less than about 1.0 pound per square foot when compressed to a thickness of about 40 percent the unconstrained high loft thickness.

According to this invention, there is also provided a method for installing an insulation product including providing an insulation product comprising an elongated conformable body of fibrous insulation material, with the conformable body of fibrous insulation having a facing adhered to a front major surface of the conformable body, wherein the facing is bonded to the insulation material with sufficient strength to provide product integrity to the insulation product when cut lengthwise, wherein the fibrous insulation material is expansible so that it will expand when unconstrained to a high loft thickness, and so that when it is placed in an insulation cavity having a thickness less than or equal to the high loft thickness it will expand to fill the insulation cavity. The fibrous insulation material has a resistance to compression less than about 1.0 pounds per square foot when compressed to a thickness of about 40 percent the predetermined thickness. The method further includes selecting an insulation cavity from a group of insulation cavities having thicknesses within the range of a minimum of at least about 40 percent of the high loft thickness to a maximum of about the high loft thickness, and installing the insulation product in the selected insulation cavity.

In yet another embodiment of the invention, the method for installing an insulation product includes providing an insulation product comprising an elongated conformable body of fibrous insulation material, with the conformable body of fibrous insulation having a facing adhered to a front major surface of the conformable body and encapsulation material on a rear major surface of the conformable body, wherein the facing and encapsulation material are bonded to the insulation material with sufficient strength to provide product integrity to the insulation product when cut lengthwise, wherein the fibrous insulation material is expansible so that it will expand when unconstrained to a high loft thickness, and so that when it is placed in an insulation cavity having a thickness less than or equal to the high loft thickness it will expand to fill the insulation cavity, and wherein the fibrous insulation material has a resistance to compression less than about 1.0 pounds per square foot when compressed to a thickness of about 40 percent the predetermined thickness. The method further includes selecting an insulation cavity from a group of insulation cavities having thicknesses within the range of a minimum of at least about 40 percent of the high loft thickness to a maximum of about the high loft thickness, and installing the insulation product in the selected insulation cavity.

Various objects and advantages of this invention will become apparent to those skilled in the art from the following detailed description of the preferred embodiment, when read in light of the accompanying drawings.

DETAILED DESCRIPTION AND PREFERRED EMBODIMENTS OF THE INVENTION

While the description and drawings disclose insulation products of fiberglass insulation, it is to be understood that the insulation material can be any compressible fibrous insulation material, such as rock wool and such as polypropylene.

Figure 1:
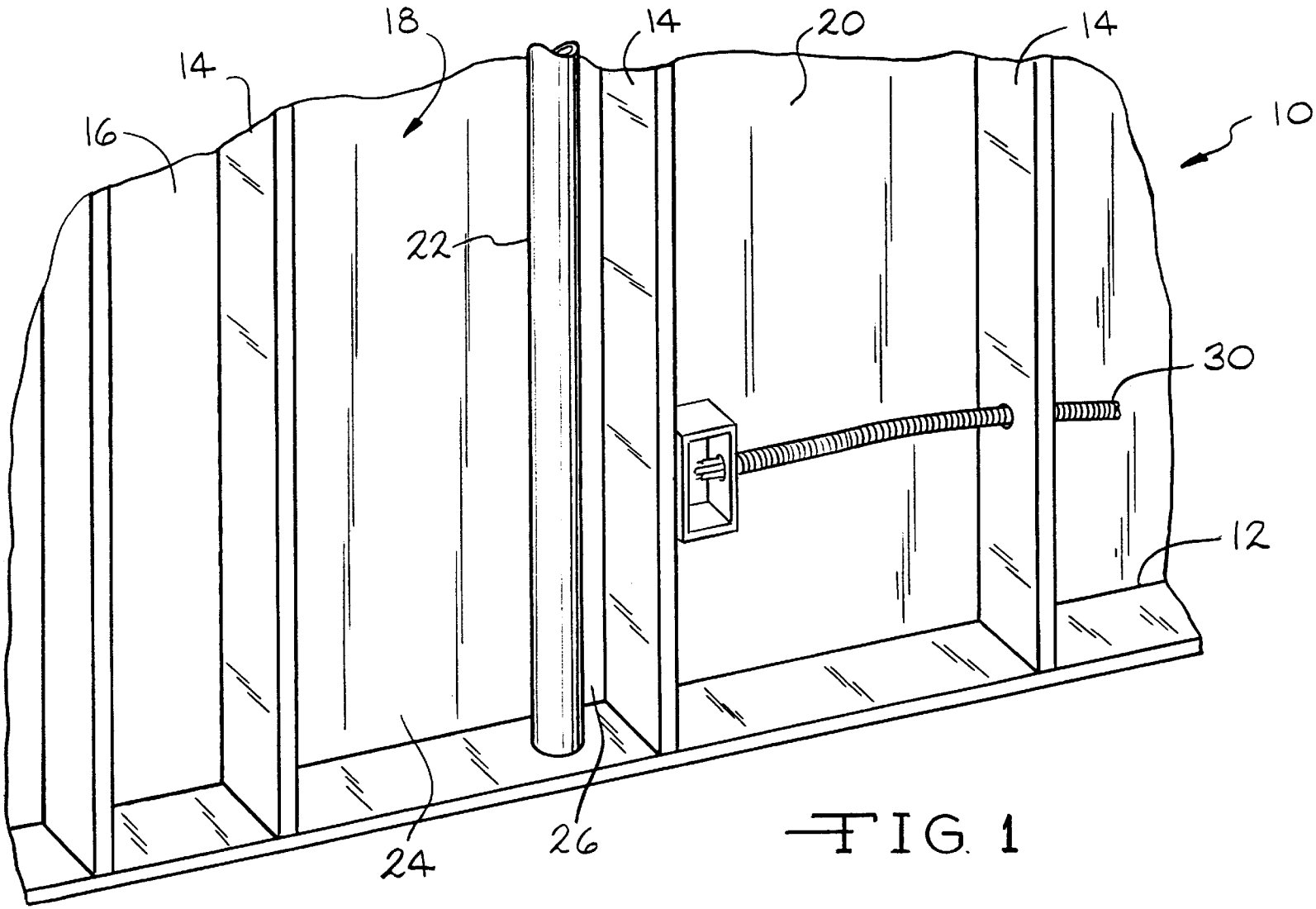
FIG. 1 is a schematic view in perspective of typical nonstandard wall insulation cavities.

As shown in FIG. 1, a typical wall structure, indicated generally at 10, includes a bottom plate 12 on which rests a plurality of studs 14. The bottom plate, studs and a top plate, not shown, define the four sides of insulation wall cavities 16, 18 and 20. The front and the back of the wall cavity are typically made of drywall on the interior side and foam or fiberboard sheathing on the exterior, both not shown. Wall cavity 16 can be considered to be a non-standard wall cavity since it has a width much narrower than that of a typical wall cavity. Insulating wall cavity 16 will require cutting the insulation product to a narrower width. Insulation cavity 18 is also difficult to insulate difficult to insulate since there is a vent pipe 22 running vertically within the cavity, making cavity 18 a nonstandard cavity. Insulating cavity 18 will usually require cutting an insulation batt longitudinally into two narrower insulation pieces, not shown in FIG. 1. For insulation purposes, insulation cavity 18 can be considered to comprise two partial cavities, indicated at 24 and 26, each of which must be insulated. Insulation cavity 20 is also a nonstandard cavity since the insulation material must be positioned around an electrical outlet box 28 and conduit 30. Installation of the insulation material around these obstructions requires cutting the batt to fit it around the obstruction. Other typical obstructions include door jambs, window frames, air ducts, and water pipes, all not shown.

Figure 2:
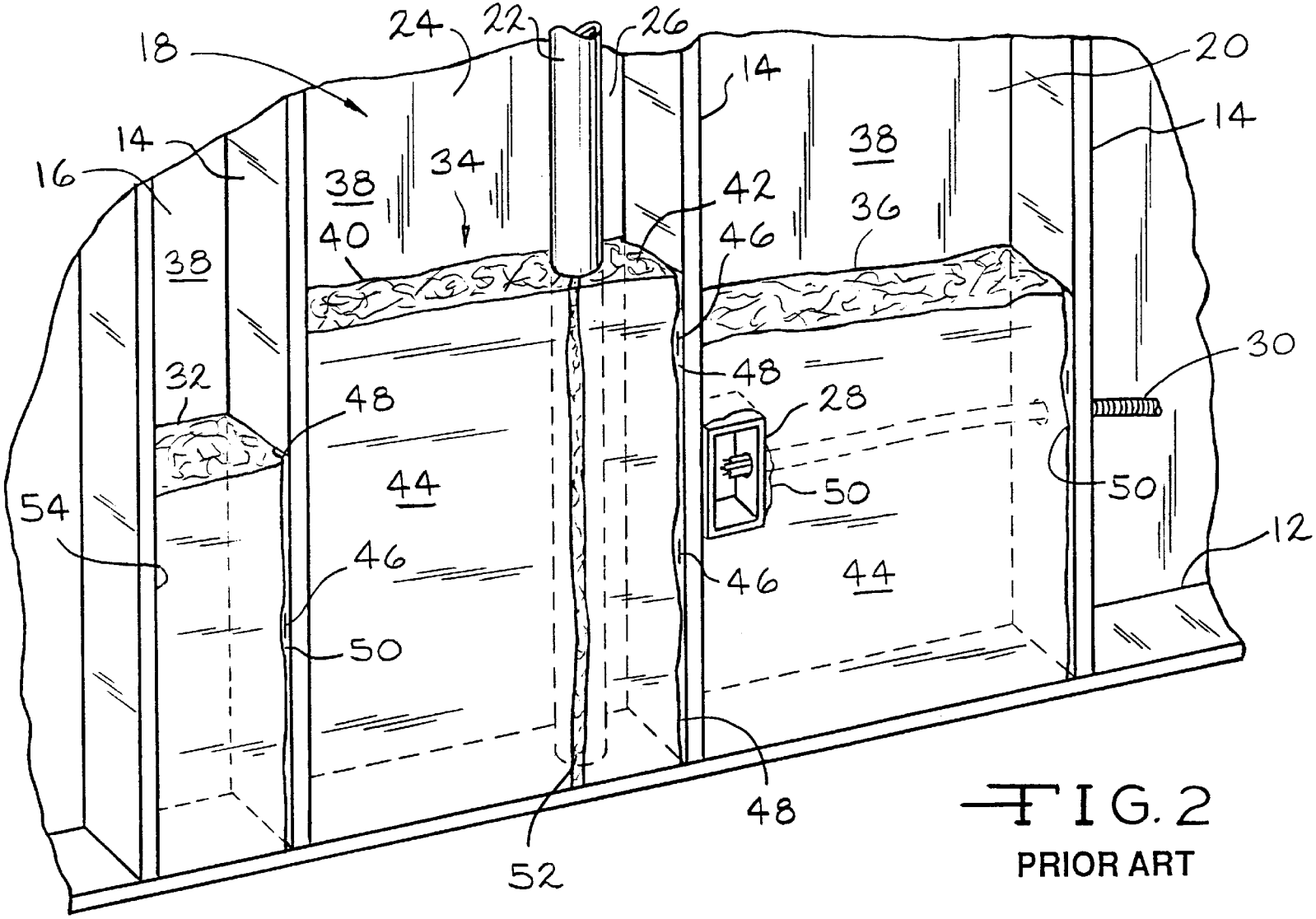
FIG. 2 PRIOR ART
FIG. 2 is a schematic perspective view of the wall cavities of FIG. 1, partially cut away and insulated with typical prior art insulation products.

As shown in FIG. 2, a typical flanged prior art insulation product has been cut to a narrow partial insulation product 32 and installed in insulation cavity 16. Prior art insulation product 34 has been installed in nonstandard wall cavity 18, and another similar prior art insulation product 36 has been installed in non standard wall cavity 20. The rear of the insulation cavities 16, 18 and 20 is defined by exterior sheathing 38. It can be seen that in order to install the insulation product 34 into the nonstandard insulation cavity 18, the insulation product was split longitudinally into two partial batts 40 and 42. Further, the facing material 44, which is a kraft paper bonded to the fibrous insulation material by asphalt, has been cut to form the two partial batts 40 and 42.

The facing material of insulation product 34 is attached to the studs 14 by means of staples 46. Although the stapling of the flanges of the insulation product 32 can be to the ends of the studs, it is preferred that the flanges be side stapled to the sides of the studs. This procedure leaves the ends or exposed edges of the studs smooth for a potentially better application of the drywall. Unfortunately the side or inset stapling of the flanges requires the asphalt/kraft facing to be bent, creating a valley-shaped depression or crease 48 running the length of the insulation product. This crease 48 is undesirable because the insulation material is prevented from flat, smooth contact with the front edge of the insulation cavity, and additionally the insulation material can be overcompressed, thereby lowering the insulation value of the insulation product. Also, the stiff asphalt/kraft facing 44 cannot always be stapled flat against the side of the stud 14, leaving fishmouth or openings 50 between the facing and the sides of the studs.

The insulation of the two partial cavities also presents a problem. It can be seen that the portions of the facing material on the two partial batts 40 and 42 are slightly separated, forming a gap 52 through which water vapor can travel into the insulation material of the batt. The gap 52 is typically caused because cutting the batt and facing material is difficult when the facing material is an asphalt/kraft paper system, as shown in FIG. 2. The openings 50 and the gap 52 are undesirable aspects of the insulation job illustrated in FIG. 2.

The installation of prior art insulation product 36 into insulation cavity 20 involved cutting out a portion of the fibrous insulation material around the electrical outlet box 28. If the insulation were installed without cutting out for the electrical outlet box, the insulation would be over compressed, and might even affect the drywall. Cutting the insulation to accommodate the outlet box required a portion of the flange to be removed. With a conventional asphalt/kraft facing it is difficult to obtain a good seal if a portion of a flange is missing. The difficulty in obtaining a good seal because of the cutout for the outlet box and other obstructions, and because of other imperfections in the structure, results in the openings 50 between the facing material 44 and the stud walls 14. Because of the stiffness of the asphalt/kraft facing combination, openings similar to openings 50 can occur even with standard insulation cavities having no obstructions in situations where the studs are uneven or out of alignment.

The partial insulation product 32 installed in narrow insulation cavity 16 has been cut longitudinally, forming a new batt edge 54 having no flange extending beyond the edge of the insulation material of the batt. This lack of a flange makes partial insulation product 32 difficult to install properly.

Figure 3:
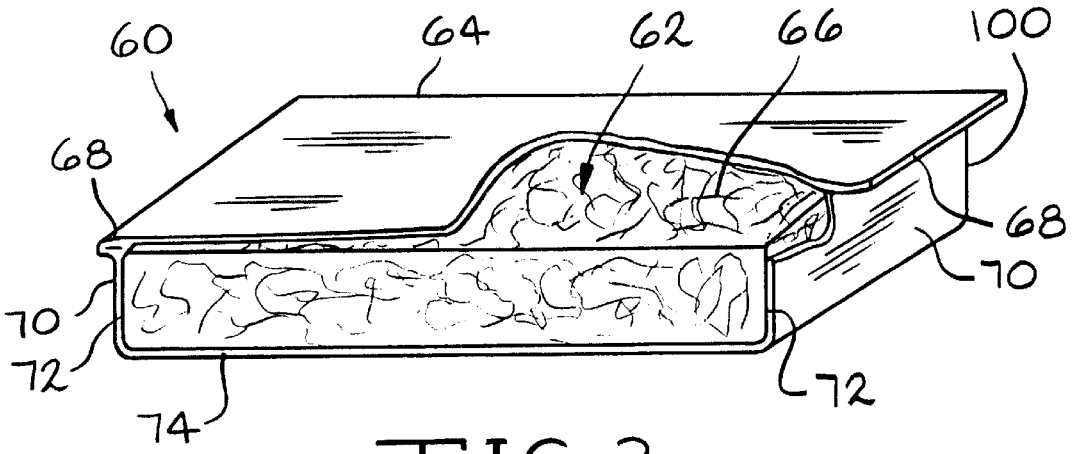
FIG. 3 is a schematic perspective view of a faced and encapsulated insulation product according to the present invention, with a portion cut away.

As shown in FIG. 3, the insulation product of the invention, indicated generally at 60, is comprised of an elongated body 62 of fibrous insulation material. Preferably the body of insulation material is a conformable body, which means that it can be shaped to fit the desired insulation cavity. A detailed description of conformable insulation bodies is provided in U.S. Pat. No. 5,508,079 to Grant and Berdan, which is herein incorporated by reference in its entirety. Preferably the fibers of the conformable body are irregular glass fibers, although straight fibers can also be used. The conformable body is preferably binderless. Binderless glass fibers will be capable of much greater movement within the insulation pack structure than fibers in a pack structure with binder. As used in the present specification and claims, the term "binderless" means the absence of binder materials or the presence of only small amounts of such binder materials, amounting to no more than one percent by weight of the insulation product. Addition of suppressants, e.g. oils, for dust control or other purposes is not considered a binder. An example of an encapsulated binderless product is disclosed in the U.S. Pat. No. 5,227,955 to Schelhorn et al., as mentioned above.

The conformable body 62 has a facing 64 adhered to the front major surface 66. The facing can be any material suitable for providing a flexible vapor barrier, such as a single layer of high density polyethylene having a thickness within the range of from about 0.6 to about 1.5 mil. The fibrous insulation material preferably has a density within the range of from about 0.3 to about 1.0 pounds per cubic foot (pcf), although other densities can be used. Also, other fibers, such as mineral fibers of rock, slag or basalt, can be used as well as organic fibers such as polymer fibers like polypropylene, polyester and polysulfide, as well as other organic fibers.

An optional material for the facing 64 is a dual layer facing, not shown, comprised of a coextruded polymer film of a barrier layer and a bonding layer, with the two layers having different softening points. A preferred material for the barrier layer is a high density polyethylene (HDPE) film, while preferred materials for the bonding layer is one or more materials of the group consisting of ethylene N-butyl acrylate, ethylene methyl acrylate and ethylene ethyl acrylate. These three materials can be used either alone, in combination with each other, or in combination with other materials, such as a low melt polyethylene material. In the alternative, a three layer coextruded film, containing a barrier layer and a bonding layer which sandwich a higher melting point carrier layer, can be used. Also, a low density or low softening point polyethylene film could be used by itself for the bonding layer.

The facing 64 is provided with overhanging flanges 68 on each of its longitudinal sides for attaching the insulation product to the studs. The insulation product 60 has, in addition to the facing material 64 on the front major surface face 66, encapsulation material 70 placed on the side edges 72 and the rear major surface 74. The encapsulation material is preferably a thinner layer of polyethylene, having a thickness of about 0.6 mil. The facing 64 and encapsulation material 70 must be adhered to the conformable body 62 of insulation material so that the insulation product can be handled during manufacturing, packaging and installation. The adhesive system must be one that does not cause the insulation product to fail the applicable fire and smoke limits for such products. Even though the embodiment of the invention shown in FIG. 3 includes encapsulation on the side edges 72 and rear major surface 74 of the conformable body of insulation material 62, it is to be understood that another embodiment of the invention provides encapsulation material on the rear surface only, with the side edges lacking the encapsulation material.

Figure 5:
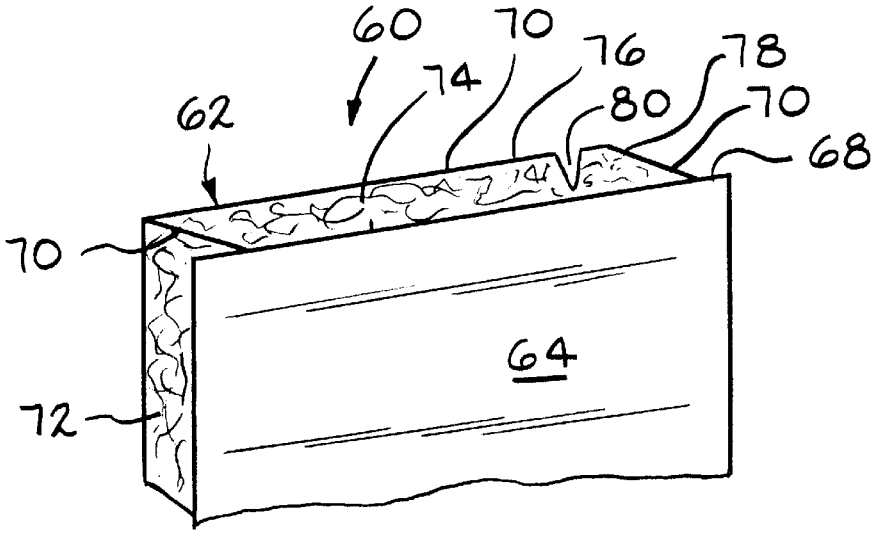
FIG. 5 is a schematic perspective view illustrating an insulation product of the invention, having been slit longitudinally along the rear face to provide an insulation product suitable for insulating one of the nonstandard insulation cavities of FIG. 1.
Figure 4:
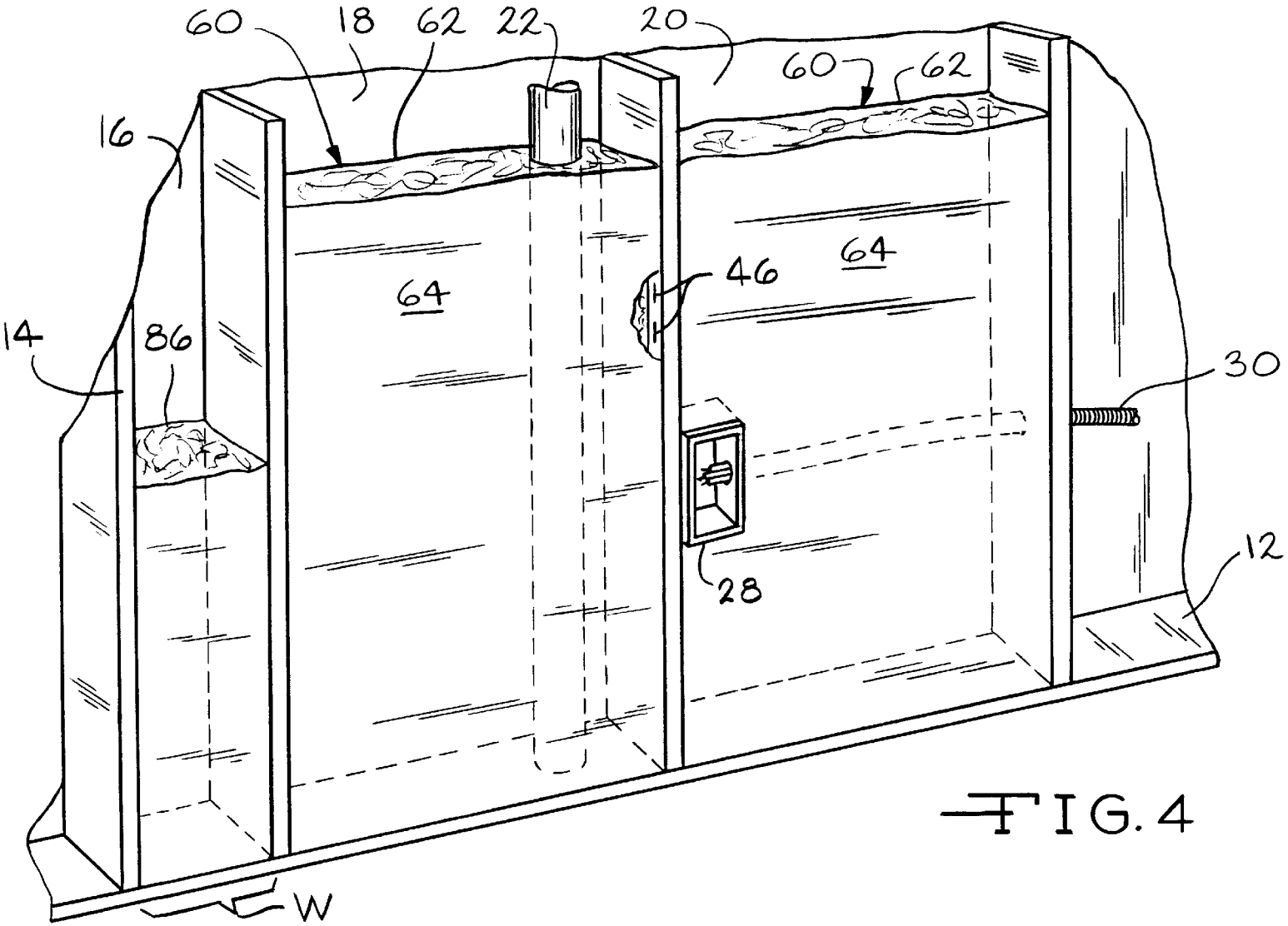
FIG. 4 is a schematic perspective view of the insulation product of FIG. 3, partially cut away and installed into the wall cavity of FIG. 1.

As shown in FIG. 4, the insulation product 60 of the invention is applied into nonstandard insulation cavities 16, 18 and 20. In order to install the insulation product 60 into insulation cavity 18, the insulation product has been slit or cut from the rear major surface 74 to partially divide the conformable insulation body 62 into two body sections 76 and 78, as shown in FIG. 5. The slit 80 extends from the rear major surface 74 toward the facing 64, but does not cut the facing. The body sections 76 and 78 can be shaped as needed in the insulation cavity 18 in order to fit around the vent pipe 22. Because of the flexibility of the insulation product 60, there is no visible evidence of the fact that the insulation product 60 is divided into two body sections 76 and 78. This is a great improvement over the asphalt/kraft faced insulation product illustrated in FIG. 2. Further, the improved flexibility of the HDPE facing material over the asphalt/kraft facing means that the crease (crease 48 in FIG. 2) associated with the stiff asphalt/kraft facing is practically eliminated, and the openings 50 are no longer present.

When the insulation product 60 is applied to insulation cavity 20, the facing 64 is cut out around the outlet box 28, and the flexibility of the facing 64 enables the facing to be stapled to the sides of the studs without undesirable openings in the facing at the edge of the insulation cavity 20.

Figure 6:
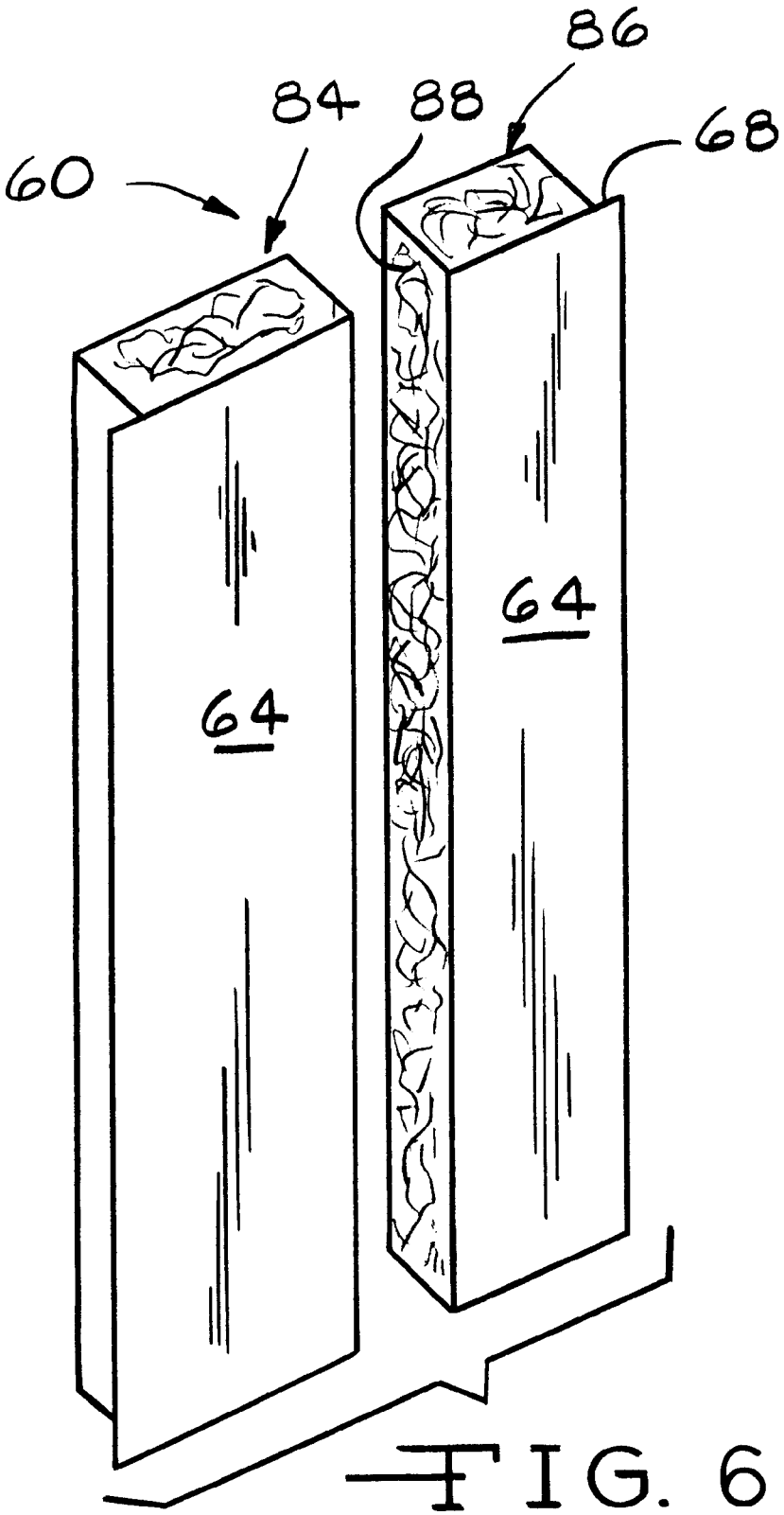
FIG. 6 is a schematic perspective view illustrating a faced and encapsulated insulation product of the invention, having been slit longitudinally to provide a partial insulation product suitable for insulating the nonstandard insulation cavity of FIG. 1.

Before the insulation product 60 is installed in a narrow cavity such as cavity 16, the insulation product must first be cut to fit the cavity. The insulation product 60 can be cut longitudinally into two longitudinal portions 84 and 86, as shown in FIG. 6. The facing 64 and encapsulation material 70, which are adhered to the fibrous insulation material in the conformable body of insulation, help hold the conformable body of insulation together after the cutting of the insulation product. It can be seen that the cut edge 88 leaves the longitudinal portion 86 with no flange on one side edge, and with the original flange 68 on the other side edge. One of the significant properties of the conformable body of insulation is that it can be pushed around or molded within the insulation cavity to fit the shape of the cavity. To take advantage of this property, and to create a flange on the cut edge 88, the insulation installer needs only to cut the longitudinal portion wider than the width W of the narrow insulation cavity 16. When the cut product 86 is installed in cavity 16, the extra facing material 64 becomes the new flange, and this new flange is stapled to the side of the stud 14. The fibers along the cut are pushed around to fit into the cavity. This would be more difficult with conventional bindered insulation because the insulation material does not conform as well to the shape of the cavity.

The primary factor in enabling the insulation product to be successfully cut into partial batts, however, is the strength of the bond between the facing 96 and the batt 98. The bond must have sufficient strength to provide product integrity to the insulation product when cut lengthwise. For purposes of this invention, the term "sufficient strength to provide product integrity to the insulation product when cut lengthwise" means that when an 8 foot long insulation product of the invention is cut into two portions along the length of the insulation product, each of the two portions can be picked up and held by grasping one end of the portion. The product integrity is sufficient to enable an insulation installer to cut the product lengthwise and to pick up, carry and install either of the two portions into a wall cavity without having the portion fall apart. Without appropriate facing and bonding of the facing, a split off portion of an insulation product of unbonded or binderless glass fibers would fall apart, and could not be picked up for installation in a wall cavity. When the insulation product is further encapsulated by adding an encapsulation film to the rear major face and even to the side edges, the product integrity is further improved.

Figure 7:
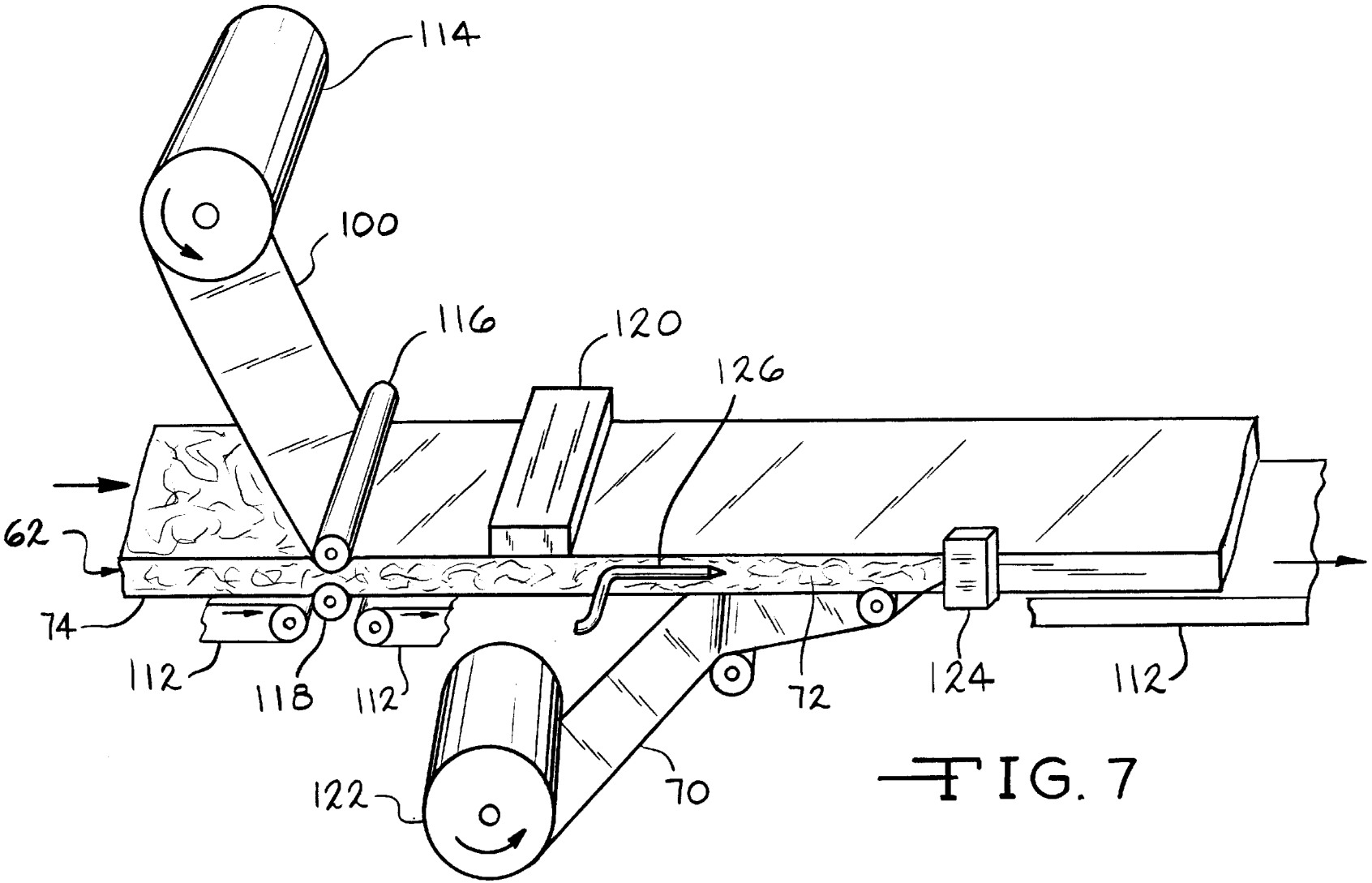
FIG. 7 is a schematic perspective view of apparatus for manufacturing the insulation the insulation products of the invention.

The encapsulation material can be applied to a continuous conformable body of insulation material by any suitable process, such as by the direct formed process, not shown, which is known to those skilled in the art. Alternatively, the facing and encapsulation material can be applied as shown in FIG. 7, in which a sheet of dual layer facing material 100, having barrier and bonding layers, is payed out from roll 114 and directed into contact with the conformable body of insulation carried by a conveyor 112. The facing material 100 is pressed into forceful contact with the conformable body 98 by the action of journaled pressing rolls 116 and 118, which compress the glass fiber conformable body by a ratio of up to 25:1, and preferably a ratio of about 10:1. The upper pressing roll 116 is heated so that the temperature of the facing 100 will increase to a point above the softening point of the bonding layer. The heating of the roll 116 can be accomplished by any means, such as by electrical resistance heating or by the circulation of hot oil. The combination of the softened bonding layer and the extreme pressure applied by the two pressing rolls 116 and 118 causes the bonding layer to firmly bond the barrier layer to the conformable body. An alternative method of heating the bonding layer is with an infrared heater 120, as shown. Such a heater would have to be positioned immediately upstream of a pair of pressing rolls, not shown, similar to rolls 116 and 118, so that the softened bonding layer could be pressed into the fibrous material and be integrally bonded to the fibers. Ultrasonic, laser and microwave bonding can also be used. Optionally, a cooling section, not shown, can be used to cool the softened bonding layer after the bonding process.

As also shown in FIG. 7, the remainder of the surface of the conformable body, i.e., the side edges 72 and the rear major surface 74 can be encapsulated with encapsulation material or film 70 which can be supplied by encapsulation film roll 122. The film 100 can be applied using a folding shoe 124, an example of which is disclosed in the above-identified U.S. Pat. No. 5,545,279 to Hall et al. As disclosed above, the encapsulation film can be bonded with small amounts of discrete adhesive bands. The adhesive can be applied by any suitable means, such as an adhesive nozzle 126, supplied with an appropriate adhesive from a source, not shown. In the alternative, the encapsulation film 100 can be securely bonded to the entire surface of the side edges and the rear major surface with a multilayer coextruded film similar to the facing 100, as disclosed above. Also, it is to be understood that the encapsulation material can be applied just to the rear surface, leaving the side edges unencapsulated.

Figure 8:
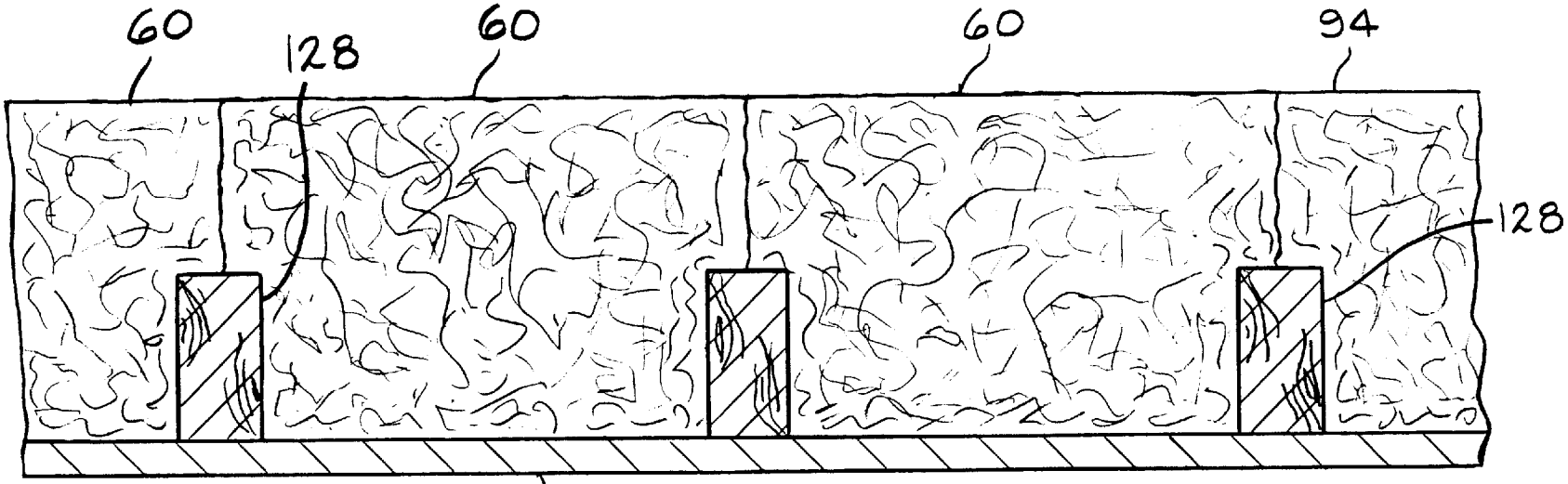
FIG. 8 illustrates the insulation product illustrated in FIG. 6 installed into an attic insulation cavity.

As shown in FIG. 8, insulation products 60 of the type shown in FIG. 3 are installed into attic insulation cavities defined by parallel extending joists 128 and ceiling drywall 130. The insulation product contains binderless glass fibers. Since the attic cavities have no upper boundary, the fibrous glass is unrestrained and the insulation is free to recover or be expanded to its unrestrained expansion height, i.e., a predetermined height.

Figure 9:
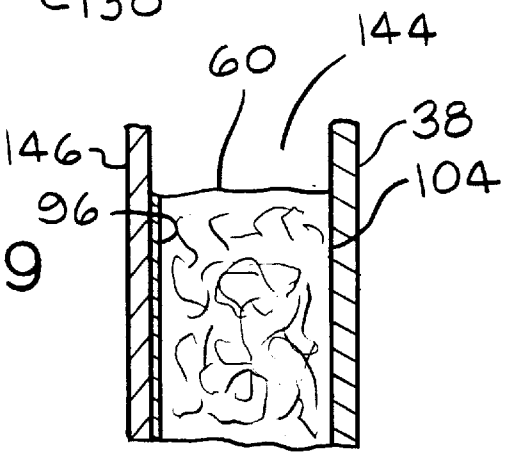
FIG. 9 is a schematic cross-sectional view in elevation of a relatively deep wall insulation cavity insulated with the insulation product illustrated in FIG. 6.
Figure 10:
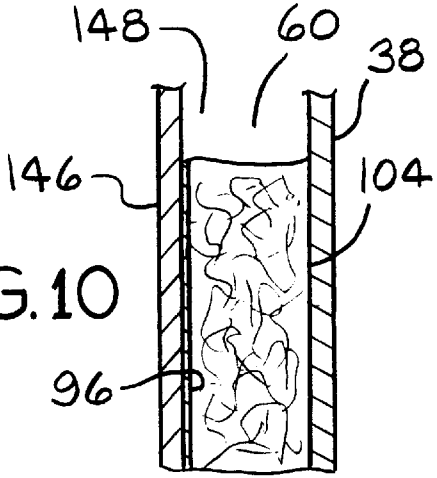
FIG. 10 is a schematic cross-sectional view in elevation of a relatively shallow wall insulation cavity insulated with the insulation product illustrated in FIG. 6.

When the insulation product 60 of the type shown in FIG. 3 is installed into more confined insulation cavities, the fibrous insulation material of the insulation product 60 must be compressed, as shown in FIGS. 9 and 10. In FIG. 9, the insulation product is installed into a relatively deep insulation cavity 144, such as a wall cavity having its thickness defined by a 2×6 wall stud. The rear major surface 74 of the insulation product 60 is in contact with the exterior sheathing 38, and the facing 64 is in contact with the drywall 146. In FIG. 10, the same insulation product 60 is installed into a relatively shallow wall insulation cavity, such as a wall cavity defined by a 2×4 wall stud. By comparing the system in FIGS. 8, 9 and 10 it can be seen that the same insulation product 60 can be installed into insulation cavities having two different constrained thicknesses and one unconstrained application, i.e., the attic. This flexibility allows insulation users to take an unconstrained R-19 product and use it in constrained spaces as well. The insulation material can be expanded to the thickness of the cavity. By marketing insulation products similar to insulation product 60 the sellers of insulation materials can offer a single product that will fit unconstrained application needs and also will fit constrained insulation cavities of smaller thicknesses, for example, a cavity having a thickness of about 40 percent of the nominal unconstrained thickness, and any cavity having a thickness between the 40 percent thickness and the unconstrained thickness. The insulation manufacturer and retailer gain an advantage because the number of products required to be offered is reduced while still fulfilling all the needs of the customers. The customer gains because it is easier to figure out the insulation needs of any particular dwelling.

When installing the insulation product 60 of the invention, the first step is to provide a faced insulation product 60 of the invention, with the facing 64 adhered to the front major surface 66 of the conformable body of insulation. The facing 64 is bonded to the insulation material with sufficient strength to provide product integrity to the insulation product when cut lengthwise. The insulation material must be expansible so it can be expanded when unconstrained to a high loft thickness, which is the maximum nominal thickness to which the insulation material can be expanded when unconstrained. When the insulation product is placed in an insulation cavity having a thickness less than or equal to the high loft thickness, the insulation product can be expanded to fill the insulation cavity. The fibrous insulation material must have a resistance to compression less than 1.0 pounds per square foot when compressed to a thickness of roughly 40 percent of the unconstrained high loft thickness. The insulation installer then selects an insulation cavity from a group of to insulation cavities, i.e., selecting a place to put the insulation from all the insulation cavities in the building that need to be filled with an insulation product. The insulation cavities in this group of insulation cavities all have thicknesses greater than or equal to about 40 percent of the unconstrained high loft thickness. The insulation installer then installs the insulation product in the selected insulation cavity, and expands the insulation product to fill the insulation cavity. It can be seen that using the above method of installation, a single insulation product of the invention can be installed in a 2×4 wall insulation cavity for an R-13 insulative value, in a 2×6 wall cavity for an R-17 insulative value, or in an unconstrained attic cavity for an R-19 insulative value, where the unconstrained or high loft thickness of the insulation product is in excess of about 6 inches.

A unique product attribute of conformable insulation product of the invention is that when placed in a constrained thickness insulation cavity the insulation can be expanded to fill the cavity, and the insulation fibers will generally conform themselves to provide a nearly uniform density. This cannot be done with conventional bindered insulation products. Further, with high loft binderless products of low square foot weight (i.e., within the range of from about 0.15 to about 0.25 pounds per square foot for an R-19 attic insulation product), the conformability provides another advantage. For high loft thickness attic insulation the product width is typically 16 inches for 16 inch joist spacing. When this product is installed into a wall cavity only 14½ inches in width, the insulation material conforms to the new shape, and changes dimensions both in the direction of the width of the insulation cavity and in the thickness of the cavity. The fibers of the conformable insulation product can shift around within the wall cavity to achieve generally uniform density. This makes use of the fact that the change in the width of the cavity increases the square foot weight and thereby allows the higher loft product to still perform with an adequate thermal value in the constrained cavity. Thus, the insulation product 60 of the invention takes advantage of the conformability, which is not present in conventional bindered insulation products.

One potential problem in using the same insulation product for different insulation cavities is that as the insulation product is compressed into shallower insulation cavities, the reactive compression force increases. If this opposite reactive force is too great, the effect will be a detachment of the exterior sheathing 38 or of the interior drywall 146. Therefore, it is imperative that the compressive force of the insulation within any cavity not be too great. For this purpose the insulation product must have a resistance to compression that is less than 1.0 pounds per square foot when compressed to a thickness of about 40 percent of the high loft thickness, which is that thickness to which the insulation product can be expanded when unconstrained. As a practical matter, most conventional fibrous glass insulation products having binder on the fibers for product integrity will have a resistance to compression that is much greater than 1.0 pounds per square foot when compressed to a thickness of about 40 percent of the unrestrained high loft thickness. However, most binderless insulation products will have a resistance to compression that is lower than 1.0 pounds per square foot when compressed to a thickness of about 40 percent of the unrestrained high loft thickness.

Another important factor in containing the compressed insulation product in a relatively shallow insulation cavity is the strength of the facing 64. Where the insulation product 60 is applied to cavities defined by wall studs, the facing must be stapled or otherwise adhered to the studs 14 to hold the insulation product in the cavity. For shallow insulation cavities in which the insulation product is significantly compressed, the facing must have sufficient tensile strength to prevent the insulation material from tearing the facing out of its staples. A typical 0.4 mil HDPE encapsulation material will be insufficient for containing a highly compressed insulation material without risking tearing the flanges away from the staples. The facing must be sufficient to withstand a pressure on the facing of at least 1.0 pounds per square foot when attached to the wall studs.

The principle and mode of operation of this invention have been described in its preferred embodiments. However, it should be noted that this invention may be practiced otherwise than as specifically illustrated and described without departing from its scope.

What is claimed is:

1. A method for installing an insulation product comprising:

providing an insulation product comprising an elongated conformable body of fibrous insulation material, with the conformable body of fibrous insulation having a facing adhered to a front major surface of the conformable body, wherein the facing is bonded to the insulation material with sufficient strength to provide product integrity to the insulation product when cut lengthwise, wherein the fibrous insulation material is expansible so that it can be expanded to an unconstrained high loft thickness, and so that when it is placed in an insulation cavity having a thickness less than or equal to the unconstrained high loft thickness it can be expanded to fill the insulation cavity, and wherein the fibrous insulation material has a resistance to compression less than about 1.0 pounds per square foot when compressed to a thickness of about 40 percent of the unconstrained high loft thickness;

selecting an insulation cavity from a group of insulation cavities having thicknesses within the range of a minimum of at least about 40 percent of the unconstrained high loft thickness to a maximum of about the unconstrained high loft thickness; and installing the insulation product in a narrow insulation cavity having a width, by:

longitudinally splitting the insulation product to create a longitudinal portion of the insulation product that is wider than the width of the narrow insulation cavity, the longitudinal portion having a first side edge with a flange and a second side edge without a flange, the second side edge having a portion of the elongated conformable body of fibrous insulation material associated with it;

installing the longitudinal portion in the narrow insulation cavity by attaching the first side edge with a flange to a wall stud; and forcing the portion of the conformable body of fibrous insulation material associated with the second side edge into the narrow insulation cavity, thereby creating a new flange.

2. The method of claim 1 in which the group of insulation cavities includes insulation cavities having a nominal design thickness of about 3½ inches and insulation cavities having a nominal design thickness of about 5½ inches.

3. The method of claim 1 in which the high loft thickness is at least 6 inches.

4. A method for installing an insulation product comprising:

providing an insulation product comprising an elongated conformable body of fibrous insulation material, with the conformable body of fibrous insulation having a facing adhered to a front major surface of the conformable body and encapsulation material on a rear major surface of the conformable body, wherein the facing and encapsulation material are bonded to the insulation material with sufficient strength to provide product integrity to the insulation product when cut lengthwise, wherein the fibrous insulation material is expansible so that it can be expanded to an unconstrained high loft thickness, and so that when it is placed in an insulation cavity having a thickness less than or equal to the unconstrained high loft thickness it can be expanded to fill the insulation cavity, and wherein the fibrous insulation material has a resistance to compression less than about 1.0 pounds per square foot when compressed to a thickness of about 40 percent of the unconstrained high loft thickness;

selecting an insulation cavity from a group of insulation cavities having thicknesses within the range of a minimum of at least about 40 percent of the unconstrained high loft thickness to a maximum of about the unconstrained high loft thickness; and installing the insulation product in the selected insulation cavity; longitudinally splitting the insulation product to create a longitudinal portion of the insulation product that is wider than the width of the narrow insulation cavity, the longitudinal portion having a first side edge with a flange and a second side edge without a flange, the second side edge having a portion of the elongated conformable body of fibrous insulation material associated with it;

installing the longitudinal portion in the narrow insulation cavity by attaching the first side edge with a flange to a wall stud; and forcing the portion of the conformable body of fibrous insulation material associated with the second side edge into the narrow insulation cavity, thereby creating a new flange.

5. The method of claim 4 in which the encapsulation material is also applied to side edges of the conformable body of fibrous insulation.

6. The method of claim 5 in which the group of insulation cavities includes insulation cavities having a nominal design thickness of about 3½ inches and insulation cavities having a nominal design thickness of about 5½ inches.

7. The method of claim 5 in which the high loft thickness is at least 6 inches.

8. The method of claim 5 including the step of insulating a narrow insulation cavity having a width, by:

longitudinally splitting the insulation product to create a longitudinal portion of the insulation product that is wider than the width of the narrow insulation cavity, the longitudinal portion having a cut edge without a flange, the cut edge having a portion of the elongated conformable body of fibrous insulation material associated with it;

installing the longitudinal portion in the narrow insulation cavity by attaching the cut first side edge with a flange to a wall stud; and forcing the portion of the conformable body of fibrous insulation material associated with the cut second side edge into the narrow insulation cavity, thereby creating a new flange.

* * * * *